US006095802A

United States Patent [19]

Kwiatek

[11] Patent Number: 6,095,802

[45] Date of Patent: Aug. 1, 2000

[54] GASEOUS FUEL BURNER AND METHOD OF MAKING SAME

[75] Inventor: David J. Kwiatek, LaGrange, Ill.

[73] Assignee: Eaton Corporation, Cleveland, Ohio

[21] Appl. No.: 08/522,186

[22] Filed: Aug. 31, 1995

[51] Int. Cl.[7] ..... F23Q 3/00

[52] U.S. Cl. ..... 431/349; 431/354; 126/39 E

[58] Field of Search ..... 431/349, 326, 431/328, 8, 354, 266; 126/39 E; 239/552, 567, 554, 555

[56] References Cited

U.S. PATENT DOCUMENTS

| | | | |
|---|---|---|---|
| 1,405,214 | 1/1922 | Hoffman | 239/556 |
| 1,663,339 | 3/1928 | Geurink et al. . | |
| 1,700,886 | 2/1929 | Geurink | 239/567 |
| 2,615,510 | 10/1952 | James et al. | 239/552 |
| 3,047,056 | 7/1962 | Flynn | 431/349 |
| 3,874,599 | 4/1975 | Roger | 239/555 |
| 5,492,469 | 2/1996 | Oda et al. | 431/266 |

*Primary Examiner*—Carl D. Price
*Attorney, Agent, or Firm*—Roger A. Johnston

[57] ABSTRACT

A cast aluminum burner base has a tubular inlet communicating with a cavity formed in an enlarged diameter flange remote from the inlet. The cavity is closed by a cast aluminum cap registered against the base. The base and cap are each castellated along the parting line such that the castellations are interdigitated. Grooves having semi-circular cross sections and formed radially across the castellations and the spaces between and close on the parting line to form circular cross section primary flame-generating ports. The castellations on the cap are truncated and tapered to provide flame stabilizing passages adjacent alternate flame-generating ports.

7 Claims, 2 Drawing Sheets

GASEOUS FUEL BURNER AND METHOD OF MAKING SAME

BACKGROUND OF THE INVENTION

The present invention relates to burners for gaseous fuel and particularly burners of the type employed for cooking appliances such as cooktop arrangements where a plurality of burners are disposed on top of a cabinet for cooking food in receptacles. The invention relates particularly to household cooktop burners where a plurality of burners are supplied from a manifold connected to a source of fuel gas with individual user operated control valves for regulating the flow of gaseous fuel to the individual burners.

Heretofore, it has been commonplace to have a plurality of cooktop burners on a domestic gas range arranged in an array with the individual burners having an annular or generally ring-shaped configuration with the flame generating ports disposed in peripherally spaced relationship to provide a ring of discrete flames emanating from the burner ports. It is known to provide such a burner with a base having a tubular inlet portion and an enlarged diameter end flange for defining a plenum or air fuel mixing cavity which is closed by a burner cap. The flame-generating ports in such a known burner design are formed in the outer annular rim of the base cavity, such that when the cap is in place gaseous fuel flowing into the tubular inlet is mixed with air typically by an inlet aspirator and is discharged through the burner ports for flame generation. Such known burners employing a base and cap have formed the flame-generating ports extending radially through the outer rim of the base which are closed by the cap to form flame-generating ports.

Heretofore such cooktop burners for mass production of domestic ranges have also employed cast metal burner bodies with flame ports drilled therethrough which has proven to be quite costly in high-volume production.

However, it has been found that the circular configuration of the drill port burner provides improved flame-generating performance and is more desirable in this aspect than a burner having grooves formed in the base which are closed by the burner cap.

In such an aforesaid cooktop burner arrangement, when sudden drafts or rapid fluctuations in the flow of fuel and air such as might be caused by debris or foreign matter in the fuel line or variations in supply pressure, the flame may be extinguished in some of the flame-generating ports and remain in others. Where the burner valve has been turned by the user to a position for very low flow, the small flames generated at the ports of the burner may be insufficient in width to reignite the gaseous fuel mixture emanating from the adjacent ports when flame has been extinguished therefrom. Thus it has been desired to provide a cooktop gaseous fuel burner which has a stable flame at varying fuel flow rates and has the ability to reignite flame at adjacent ports when the flame has been extinguished in some but not all the burner ports and which is capable of high volume mass production at low manufacturing cost.

SUMMARY OF THE INVENTION

It is an object of the present invention to provide a gaseous fuel burner for cooktop applications which has improved flame generating properties and is easy to fabricate and low in manufacturing cost and suitable for high-volume production.

It is another object of the present invention to provide a gaseous fuel burner for cooktop applications which may be cast as a base and cap and which requires little if any machining to provide for flame-generating ports in the burner.

It is a further object of the invention to provide a gaseous fuel burner for cooktop applications having a base and cap received thereover for forming flame-generating ports partially in the base and partially in the cap and to retain a circular port configuration.

It is another object of the present invention to provide a gaseous fuel burner for cooktop applications having a base and cap thereover with the flame-generating ports formed partially in the base and partially in the cap having a round port configuration when the cap is in place and for providing flame stabilization passages to facilitate flame propagation and regeneration.

It is a further object of the present invention to provide a gaseous fuel burner for cooktop applications having a cast base and cap assembled on a castellated parting line with flame-generating ports formed partially in the base and partially in the cap with a circular configuration and having flame stabilization passages provided along the parting line at certain locations.

The present invention provides a gaseous fuel burner for cooktop applications having a body preferably cast of light metal with a tubular inlet providing aspiration of air upon connection to a source of gaseous fuel and which supplies an open cavity formed in an enlarged diameter end flange on the body. The outer rim of the cavity has a castellated edge with portions of flame-generating ports formed thereon. The cavity is closed by a burner cap having corresponding interdigitated castellations thereon with the balance of the flame-generating ports formed therein such that, upon assembly of the cap to the base and interdigitation of the castellated portions, the burner ports are formed with circular cross-section. The interdigitation of the castellated portions of the cap and base is such that alternate flame-generating ports have stabilization passages formed adjacent thereto between the castellations to facilitate stabilization and regeneration upon extinguishment.

DETAILED DESCRIPTION

Figure 1:
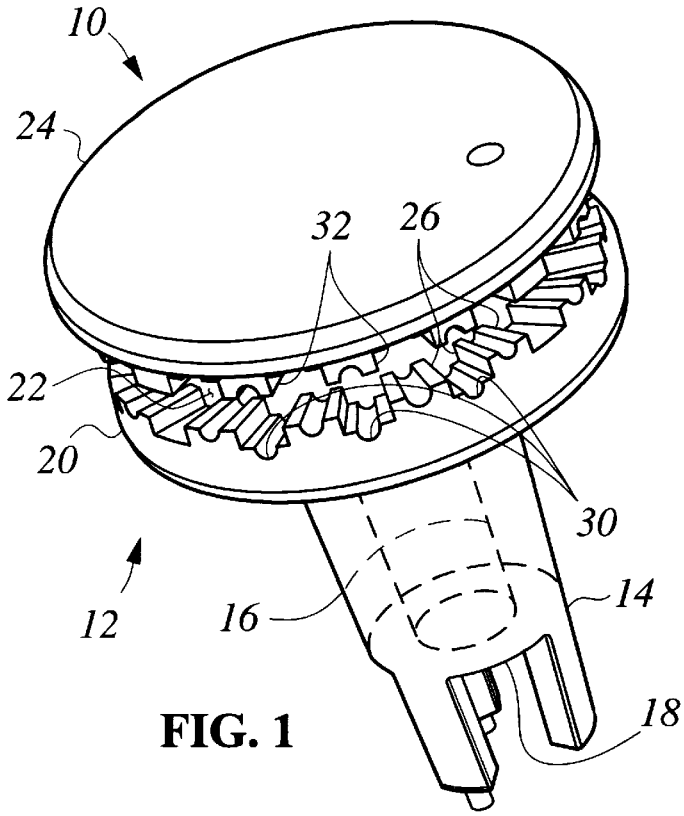
FIG. 1 is an exploded view of the burner assembly of the present invention showing the cap raised from the base.

Referring to FIGS. 1–4, the burner assembly of the present invention is indicated generally at 10 and has a base indicated generally at 12 having a tubular inlet portion 14 having an inlet passage 16 with cutouts 18 formed in the end thereof for aspirating air upon connection of a fuel supply conduit (not shown) to the inlet passage 16. Base 12 has formed integrally therewith on the end opposite cutouts 18 an enlarged diameter generally circular flange portion 20 which has formed in the end face thereof a cavity 22 which communicates with inlet passage 16. A burner cap 24 is disposed for, upon assembly to the base, closing cavity 22 to form a plenum or mixing chamber for the fuel air mixture entering cavity 22 through inlet passage 16.

The axial end face of the outer rim of flange 20, which forms the peripheral wall of cavity 22, is castellated with a plurality of circumferentially or annularly spaced axial projections denoted by reference numeral 26. In the presently preferred practice the base 12 is cast of aluminum material and the castellations or projections 26 have a generally rectangular configuration and are disposed in circumferentially equally spaced arrangement with the width in the circumferential direction equal for each of the projections 26. The top or axial end face surface 27 of each of the projections 26 is disposed to lie in a common plane to provide a generally flat peripheral surface to the rim of flange 20. Each of the top or axial end face surfaces 27 of the projections 26 has formed thereacross, in a radial direction, a groove 28 having preferably a semi-circular cross-section.

Figure 2:
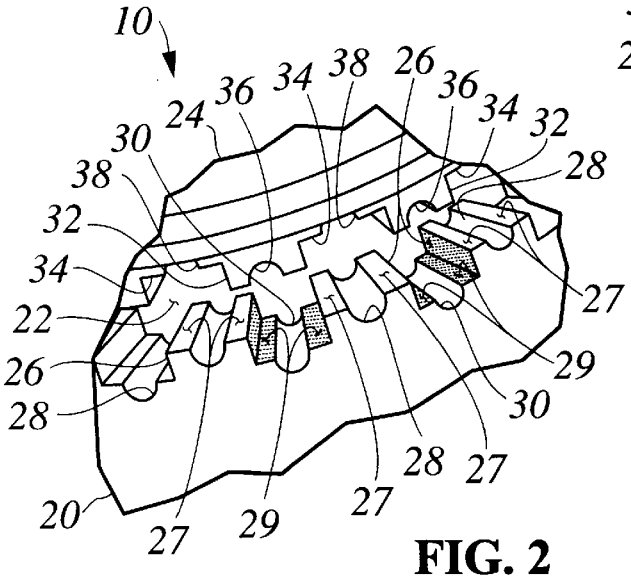
FIG. 2 is an enlarged view of a portion of the assembly of FIG. 1.

The circumferentially extending spaces between each of the projections 26 shown stippled in FIG. 2 have a generally rectangular cross-section and have formed in the bottom or axial face 29 thereof a groove 30 with a preferably semi-circular cross-section similar to grooves 28.

The burner cap 24 which is preferably cast of aluminum material has a plurality of circumferentially or annularly spaced projections 32 extending axially downwardly therefrom and configured to be interdigitated between the projections 26 of the burner base such that the cap surfaces 34 between the projections 32 register against the tops 27 of the projections 26 on the base.

Figure 3:
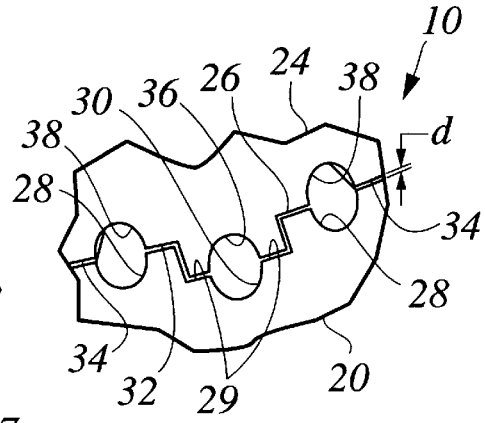
FIG. 3 is a portion of the burner assembly of FIG. 1 with the cap assembled onto the base; and, FIG. 4 is a cross-section taken through the base of the embodiment of FIG. 1.
Figure 4:
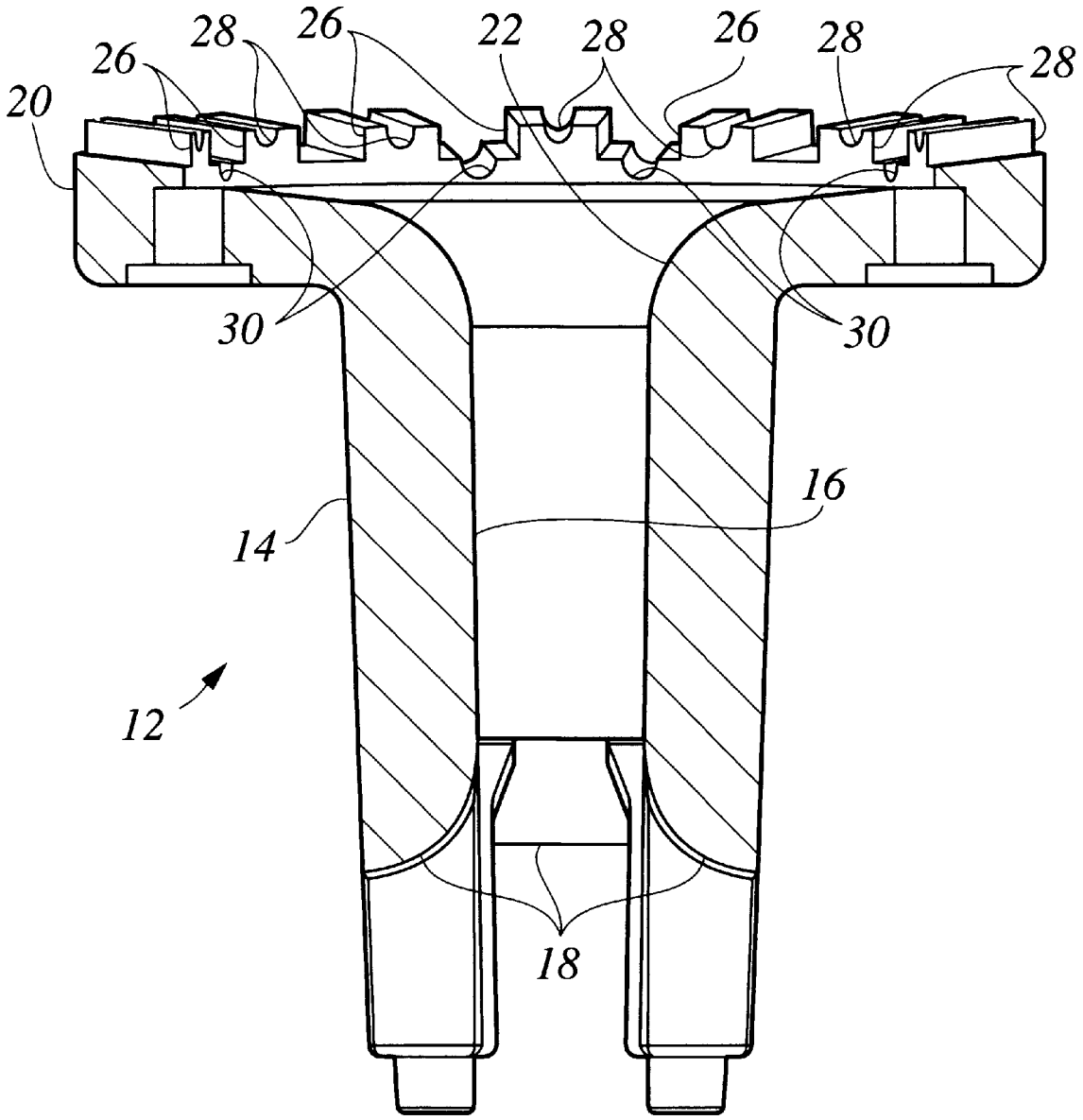

Each of the projections 32 on the cap 24 has the sides thereof slightly tapered as shown in FIGS. 2 and 3; and, the axial length or the depth thereof slightly less than the depth or corresponding height in the axial direction of the castellated portions 26 on base 14 such that, on assembly of the cap against the base, as shown in FIG. 3 a slight gap denoted by the reference character "d" in FIG. 3 exists between the projections 32 in the cap and the bottom 29 of the stippled grooves between the projections 26. This gap in conjunction with the tapered sides of cap projections 32 creates a flame stabilization passage around the projections 32 to permit a small amount of gaseous fuel air mixture to flow outwardly therethrough.

Each of the downward projections 32 on burner cap 24 has formed on the axial face or bottom thereof a radially extending groove denoted by reference numeral 36 which is preferably semi-circular in cross-section and which corresponds to and is located coincident with the adjacent groove 30 formed in the burner base 14 such that when the cap is registered against the burner base 14, the grooves 36 and 30 form a circular in cross-section flame-generating port through the rim of the burner flange 20. Similarly, radially extending grooves 38 are formed in the space between the projections 34 on the burner cap; and, these grooves 38 are disposed opposite the corresponding grooves 28 formed in the projections 26 on the burner base such that each pair of grooves 38,28 forms a primary flame-generating port having a circular cross-section. Thus, when the burner cap is registered against the burner base, each of the stippled spaces between the projections 26 has an auxiliary stabilization passage formed therein about the interdigitated downwardly extending projection 38 from the burner cap to provide small flow for stabilizing the flame in the corresponding primary burner port comprising the grooves 36,30.

The present invention thus provides a unique and novel gaseous fuel burner for cooktop applications having a cast aluminum base having a tubular inlet with an enlarged annular flange formed at one end forming a plenum therein when a cast aluminum burner cap is closed thereagainst. The parting line between the base and burner cap has a castellated configuration in the preferred form and comprises interdigitated preferably rectangular projections each having a groove formed in the end face thereof and in the bottom of the spaces therebetween with the grooves having a semicircular cross-section such that upon closure of the cap against the burner the corresponding adjacent pairs of grooves form primary flame-generating ports having a circular cross-section. The interdigitation of alternation projections on the cap with the spaces between the projections on the burner base provide a slight gap therebetween to form auxiliary flame stabilization passages for the flame emanating from the primary port formed therebetween.

Although the interdigitated projections of the cap and base in the preferred practice have a castellated or rectangular configuration, it will be understood that the interdigitation may have a saw-toothed configuration wherein the projections on the base and cap have a generally triangular cross-section.

Although the present invention has hereinabove been described with respect to the illustrated embodiments, it will be understood that the invention is capable of modification and variation and is limited only by the following claims.

What is claimed is:

1. A fuel gas burner comprising:

(a) an annular or ring-shaped base having a tubular inlet portion adapted for connection to a source of fuel gas and air and an enlarged diameter portion defining a plenum cavity;

(b) a generally circular burner cap registered against said enlarged portion and closing said cavity to form a plenum chamber;

(c) said cap and base cooperating to define a plurality of peripherally spaced generally circular flame generating ports communicating with said cavity with a portion of each port formed in said cap and the remainder of each port formed in said base with said ports staggered about the periphery; and, (d) said cap and base cooperating to define a plurality of flame stabilizing passages from said plenum with said stabilizing passages disposed intermediate said flame-generating ports.

2. The burner assembly defined in claim 1, wherein said cap and base are formed with a plurality of castellations with said castellations interdigitated and forming said flame-generating ports.

3. The burner assembly defined in claim 1, wherein said cap and base are castellated with said castellations interdigitated with said flame stabilizing passages formed between said castellations.

4. The burner assembly defined in claim 1, wherein one-half of each flame-generating port is formed in said cap and the remaining half is formed in said base.

5. The burner assembly defined in claim 1, wherein said cap and base each have teeth formed on the adjoining surface and said cap teeth are interdigitated with said base teeth; and, each of said teeth forms a portion of one of said flame-generating ports.

6. The burner assembly defined in claim 1, wherein one semicircular section of said ports is formed in said base and the remaining semicircular section formed in said cap with adjacent flame stabilizing passages formed on interdigitated portions of said cap and base.

7. The burner assembly defined in claim 1, wherein said ports each have one semicircular full-radius section formed in said base and the remaining semicircular full-radius section formed in said cap with adjacent flame stabilizing passages formed on interdigitated portions of said cap and base.

* * * * *